US009139970B1

(12) United States Patent
Little

(10) Patent No.: US 9,139,970 B1
(45) Date of Patent: Sep. 22, 2015

(54) ANIMAL WASTE COLLECTION DEVICE

(71) Applicant: Ronald J. Little, Spotsylvania, VA (US)

(72) Inventor: Ronald J. Little, Spotsylvania, VA (US)

( * ) Notice: Subject to any disclaimer, the term of this patent is extended or adjusted under 35 U.S.C. 154(b) by 0 days.

(21) Appl. No.: 14/461,837

(22) Filed: Aug. 18, 2014

Related U.S. Application Data

(60) Provisional application No. 61/866,782, filed on Aug. 16, 2013.

(51) Int. Cl.
*A01K 29/00* (2006.01)
*E01H 1/12* (2006.01)

(52) U.S. Cl.
CPC ..... *E01H 1/1206* (2013.01); *A01K 29/00* (2013.01); *E01H 2001/1293* (2013.01)

(58) Field of Classification Search
CPC ..... E01H 1/1206; E01H 2001/1293; A01K 23/005
USPC ..... 294/1.4, 1.5; 15/257.3, 257.6
See application file for complete search history.

(56) References Cited

U.S. PATENT DOCUMENTS 4,042,269 A * 8/1977 Skermetta ..... 294/1.5
4,252,356 A 2/1981 Tokuzumi
4,368,907 A * 1/1983 Ross ..... 294/1.4
4,477,111 A 10/1984 Crooks
4,741,566 A * 5/1988 Byung-Do et al. ..... 294/1.4
5,498,046 A 3/1996 Ridley, Sr. et al.
5,671,959 A * 9/1997 Tsou ..... 294/1.4
6,135,520 A * 10/2000 Miller et al. ..... 294/1.4
6,164,710 A * 12/2000 Shibuya ..... 294/1.5
7,431,360 B1 10/2008 Bielak
7,854,455 B2 12/2010 Ruscil et al.
8,066,311 B2 11/2011 Axelrod
8,292,339 B1 10/2012 Auseklis
2003/0044567 A1 3/2003 Jevons
2004/0080168 A1 * 4/2004 Tsou ..... 294/1.4
2011/0309645 A1 12/2011 Briscoe
2012/0235431 A1 9/2012 Beaton
2013/0034316 A1 2/2013 Reihanifam

FOREIGN PATENT DOCUMENTS

WO 9428252 12/1994
WO 2006104492 A2 10/2006

* cited by examiner

*Primary Examiner* — Dean Kramer
(74) *Attorney, Agent, or Firm* — Robert C. Montgomery; Montgomery Patent & Design L.P.

(57) ABSTRACT

An animal waste collection device includes an elongated shaft including a first end and an opposed second end, a handle assembly connected to the first end of the shaft, and a collection bucket assembly connected to the second end of the shaft. The handle assembly is operatively connected to the collection bucket assembly to collect animal waste within the collection bucket assembly and release the animal waste from the collection bucket assembly.

18 Claims, 9 Drawing Sheets

ANIMAL WASTE COLLECTION DEVICE

RELATED APPLICATIONS

The present invention was first described in and claims the benefit of U.S. Provisional Application No. 61/866,782, filed Aug. 16, 2013, the entire disclosures of which are incorporated herein by reference.

FIELD OF THE INVENTION

The present invention relates generally to animal waste collectors and, more particularly, to an animal waste collection device capable of entrapping and collecting animal waste into a waste collection bag and selectively release the bag into a trash receptacle without physically touching the bag.

BACKGROUND OF THE INVENTION

The act of walking a dog or other pet is a pleasure enjoyed by many pet owners. The ability to get outside and experience nature and the surroundings is a simple joy. There are also the great health benefits associated with exercise for both the dog and the human walker.

However, one additional task associated with walking of a dog is the cleaning up of droppings. This act is not only the responsible thing to do, but it is the sanitary thing to do as well. To accomplish this task, one must carry a bag and/or a small shovel with them as the dog or pet is being walked. No matter the process used, it is a messy, smelly situation that no one enjoys. It also requires bending over to perform the task, which many, such as the elderly or disabled, are incapable of doing. Finally, it requires direct handling of the droppings as well as the bag into which they are placed.

Accordingly, there is a need for a means by which one can quickly and effectively retrieve dog or pet droppings from yards or lawn areas without the mess, fuss, and smell.

SUMMARY OF THE INVENTION

The inventor has recognized the aforementioned inherent problems and lack in the art and observed that there is a need for an improved animal waste collection device. The development of the present invention, which will be described in greater detail herein, substantially departs from conventional solutions to fulfill this need.

In one (1) embodiment, the disclosed animal waste collection device includes an elongated shaft including a first end and an opposed second end, a handle assembly connected to the first end of the shaft, and a collection bucket assembly connected to the second end of the shaft. The handle assembly is operatively connected to the collection bucket assembly to collect animal waste within the collection bucket assembly and release the animal waste from the collection bucket assembly.

In another embodiment, the disclosed animal waste collection device includes an elongated shaft including a first end and an opposed second end. The animal waste collection device includes a handle actuator connected to the first end of the shaft. The handle actuator includes a grip connected to the first end of the shaft, and a lever pivotally connected to the grip. The animal waste collection device includes a plunger mechanism movable between an extended position and a retracted position. The plunger mechanism includes a first linkage including a first end extending from the first end of the shaft and a second end positioned at the second end of the shaft, a knob connected to the first end of the first linkage, and an extraction bar connected to the second end of the first linkage. The animal waste collection device includes a collection bucket assembly connected to the second end of the shaft. The collection bucket assembly includes a collection bucket including a first opening, an opposed second opening, and defining an internal volume, and a bucket lid pivotally connected to the collection bucket. The bucket lid is movable between an open position away from the collection bucket exposing the first opening and a closed position in contact with the collection bucket and covering the first opening. The animal waste collection device includes a second linkage connected to the lever. The animal waste collection device includes a third linkage operatively interconnected to the second linkage and the bucket lid. The animal waste collection device includes a bag connected to the first opening of the collection bucket, disposed within the internal volume of the collection bucket, and extending outwardly from the second opening of the collection bucket. Actuation of the lever moves the bucket lid into the closed position to collect animal waste within the bag through the first opening of the collection bucket. Movement of the plunger mechanism to the extending position moves the extraction bar into the interior volume of the collection bucket and engages the bag with the extraction bar to disconnect the bag from the collection bucket and release the bag and the animal waste from the collection bucket through the second opening of the collection bucket.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
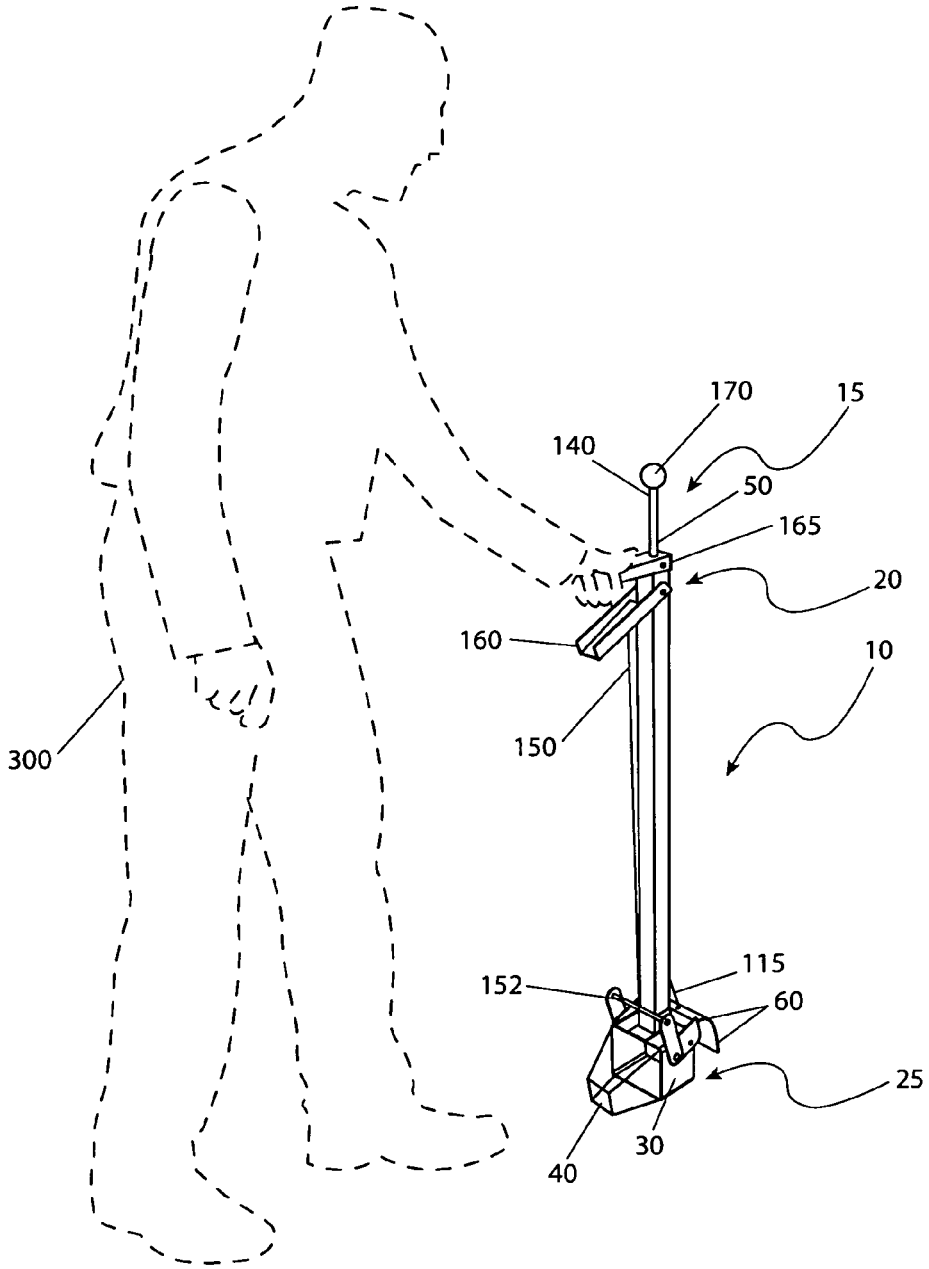
FIG. 1 is an environmental view of an animal waste collection device, according to an embodiment of the present invention.

10 animal waste collection device
11 animal excrement
15 handle assembly
20 handle actuator
25 collection bucket assembly
30 collection bucket
32 receiver
34 gusset plate
40 bag
42 extraction tab
44 bag opening
46 border
50 plunger mechanism
60 bucket lid
62 mounting ear
70 elongated shaft
80 extraction bar
90 first bucket opening
100 second bucket opening
115 first return-assist
120 plunger locking knob
122 plunger locking block
124 locking spring
126 notch
140 first linkage
150 second linkage
152 third linkage
154 first hinge pin
156 second hinge pin
160 lever
162 third hinge pin
165 grip
170 knob
175*a* first eyelet
175*b* second eyelet
175*c* third eyelet
175*d* fourth eyelet
200 inner wall
215 second return-assist
300 user

DETAILED DESCRIPTION OF THE INVENTION

In accordance with the invention, the best mode is presented in terms of a one or more of the disclosed embodiments, herein depicted within FIGS. 1 through 4D. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4D, disclosing an animal waste collection device (herein described as the "device") 10, where like reference numerals represent similar or like parts. The device 10 includes a handle assembly 15 that includes a plunger mechanism 50 and a handle actuator 20. The plunger mechanism 50 actuates a remote collection bucket assembly 25 resulting in entrapment of collected animal excrement 11 within a collection bucket 30 of the collection bucket assembly 25. The handle actuator 20 acts to contain the animal excrement 11 into a bag 40 installed within the collection bucket assembly 25 for proper disposal thereof.

Referring to FIG. 1, in an embodiment of the device 10, the handle assembly 15 (e.g., the handle actuator 20 and the plunger mechanism 50) is spaced away from the collection bucket assembly 25. For example, the handle actuator 20 and the plunger mechanism 50 are connected to a first end of a hollow elongated shaft 70 and the collection bucket assembly 25 is connected to a second end of the shaft 70. In an example construction, the portions of the device 10 are envisioned being made using rugged light-weight materials such as steel, aluminum, and plastic.

The device 10 functions by first installing a semi-rigid rectangular plastic bag 40 within inner wall surfaces 200 of the collection bucket 30 of the collection bucket assembly 25. The collection bucket 30 includes an open-ended rectangular structure having a first bucket opening 90 and an opposing second bucket opening 100. The collection bucket 30 provides pivoting attachment of a bucket lid 60 along the first bucket opening 90, whereas the second bucket opening 100 provides a means to extend and extract the bag 40.

In use, the device 10 is positioned with the elongated shaft 70 in a near vertical orientation with the collection bucket assembly 25, containing the bag 40, resting upon a ground surface.

A first linkage 140, for example, being made using a solid rod material, extends from the plunger mechanism 50 through the hollow center of the elongated shaft 70 and into the collection bucket 30 where it provides attachment of a bag extraction bar 80 upon an end. A second linkage 150, for example, being made using a length of thin cable or similar flexible cord material, extends from the handle actuator 20 to the bucket lid 60 (FIGS. 3A, 3B, and 3C) and is routed along an outer surface of the elongated shaft 70. The second linkage 150 may also be positioned to run through a center of the hollow elongated shaft 70 along with the first linkage 140 if desired and, as such, should not be interpreted as a limiting factor.

The bucket lid 60 is actuated remotely by manipulating the handle actuator 20 of the handle assembly 15, which in turn acts upon the second linkage 150 to motion the bucket lid 60 into a closed state causing the animal excrement 11 to be motioned by the bucket lid 60 into the bag 40 positioned within the collection bucket 30.

When in a vertical orientation, the elongated shaft 70 is permanently affixed to a top surface of the collection bucket 30 using known methods such as welding, fasteners, or the like.

The elongated shaft 70 include an extraction bar 80 to aid in separation and removal of the bag 40 following entrapment of the animal excrement 11, being activated remotely by the first linkage 140 using the plunger mechanism 50 and knob 170 (FIGS. 4A through 4D).

Figure 2A:
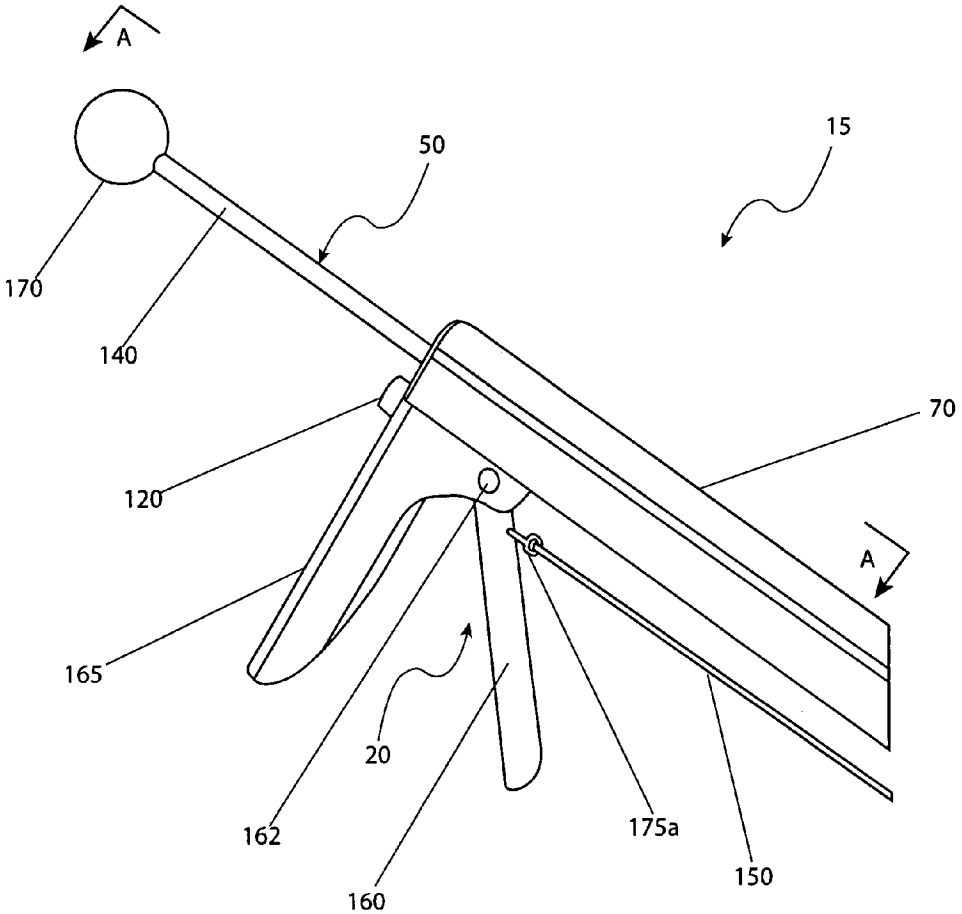
FIG. 2A is a perspective view of the handle assembly of the animal waste collection device, according to an embodiment of the present invention.
Figure 2B:
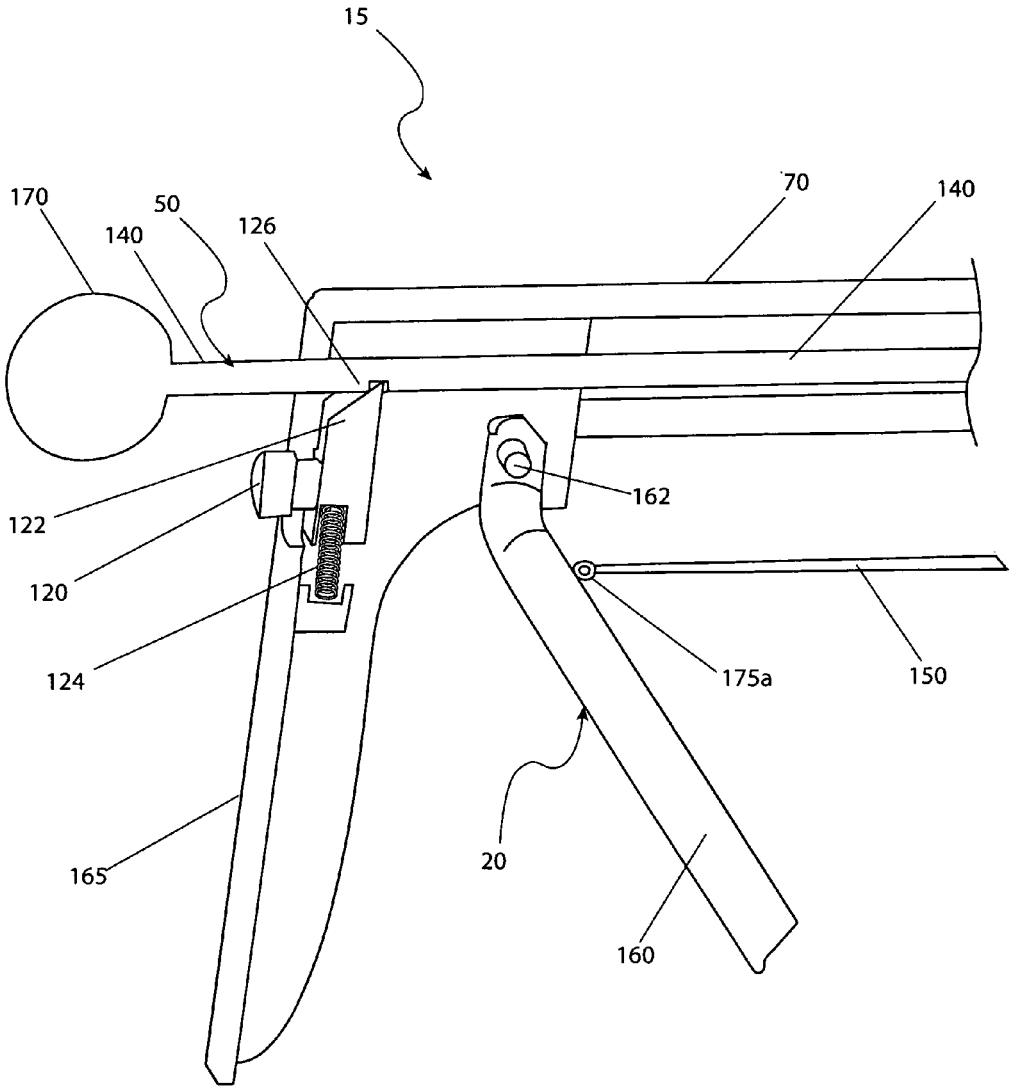
FIG. 2B is a sectional view of the handle assembly of the animal waste collection device taken along section line A-A of FIG. 2A.
Figure 2C:
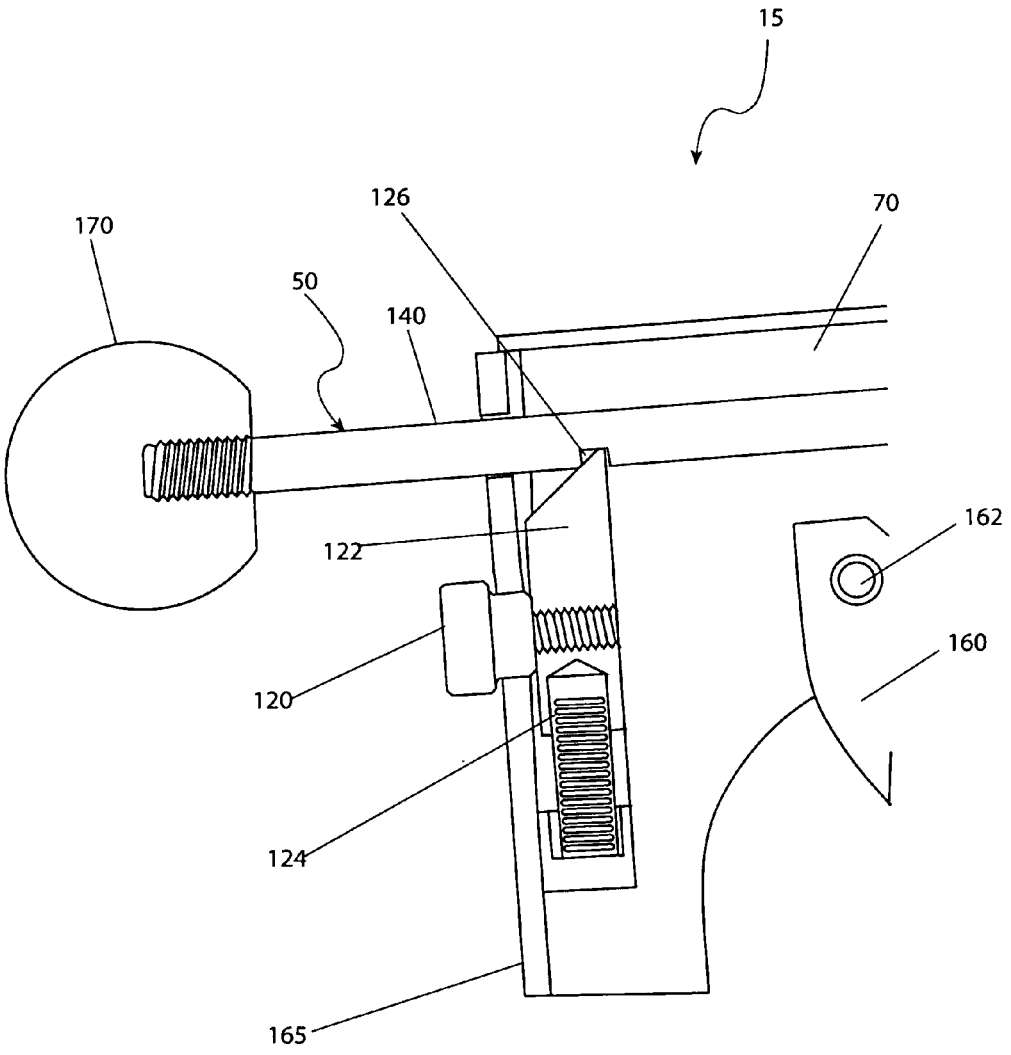
FIG. 2C is a close-up sectional view of the handle assembly of the animal waste collection device taken along section line A-A of FIG. 2A.

Referring to FIGS. 2A, 2B, and 2C, in an embodiment of the device 10, the handle assembly 15 includes the handle actuator 20 and the plunger mechanism 50. The handle actuator 20 includes a lever 160 pivotally connected to the elongated shaft 70 using a third hinge pin 162. The second linkage 150 is affixed to the lever 160 via a first eyelet 175*a*. Pivoting of the lever 160 about the third pivot pin 162 places tension on the second linkage 150, which in turn rotates the bucket lid 60 to a closed state (FIG. 3B). The second linkage 150 is envisioned to include a length of cable having suitable strength to transfer linear tensile forces from the handle actuator 20 to the bucket lid 60.

Figure 3A:
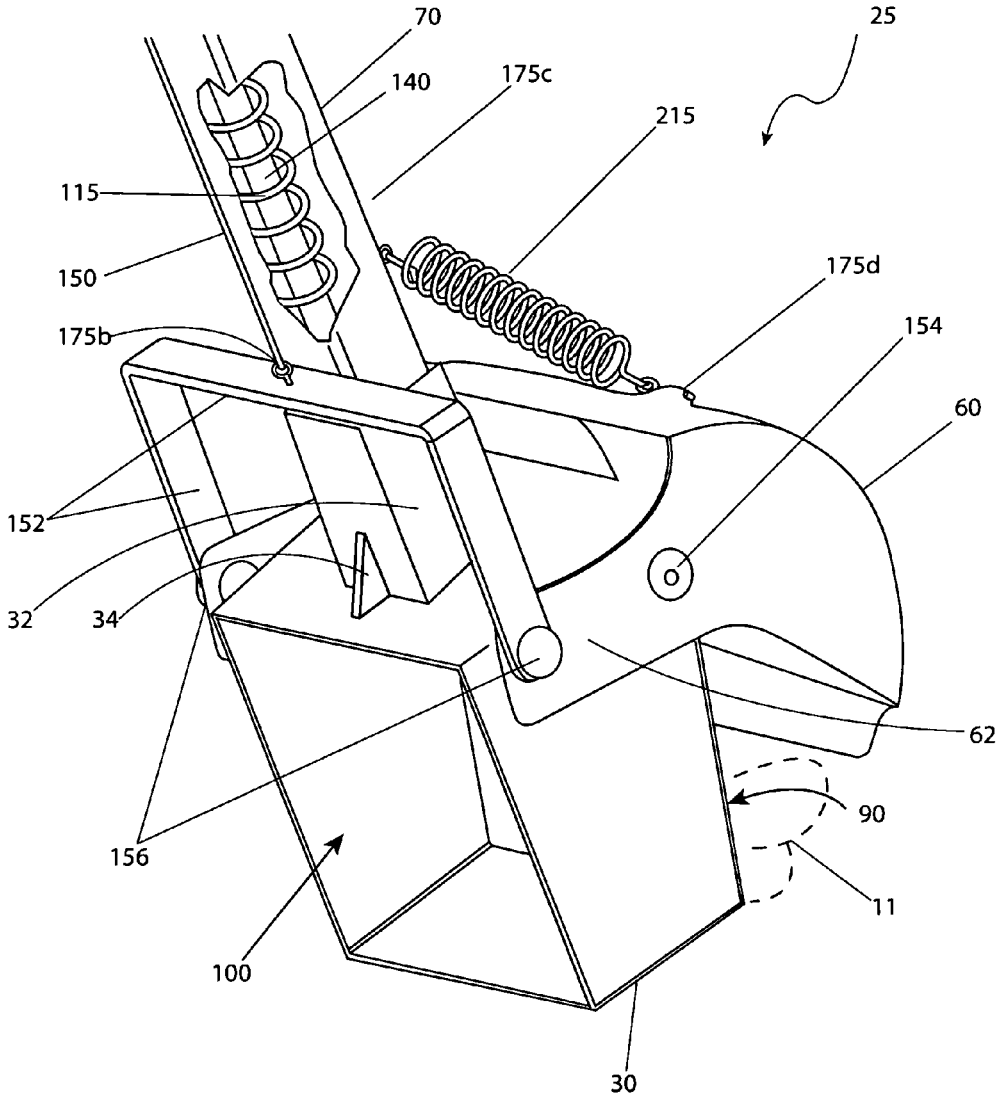
FIG. 3A is a side perspective view of the collection bucket assembly of animal waste collection device depicting an open state, according to an embodiment of the present invention.
Figure 3B:
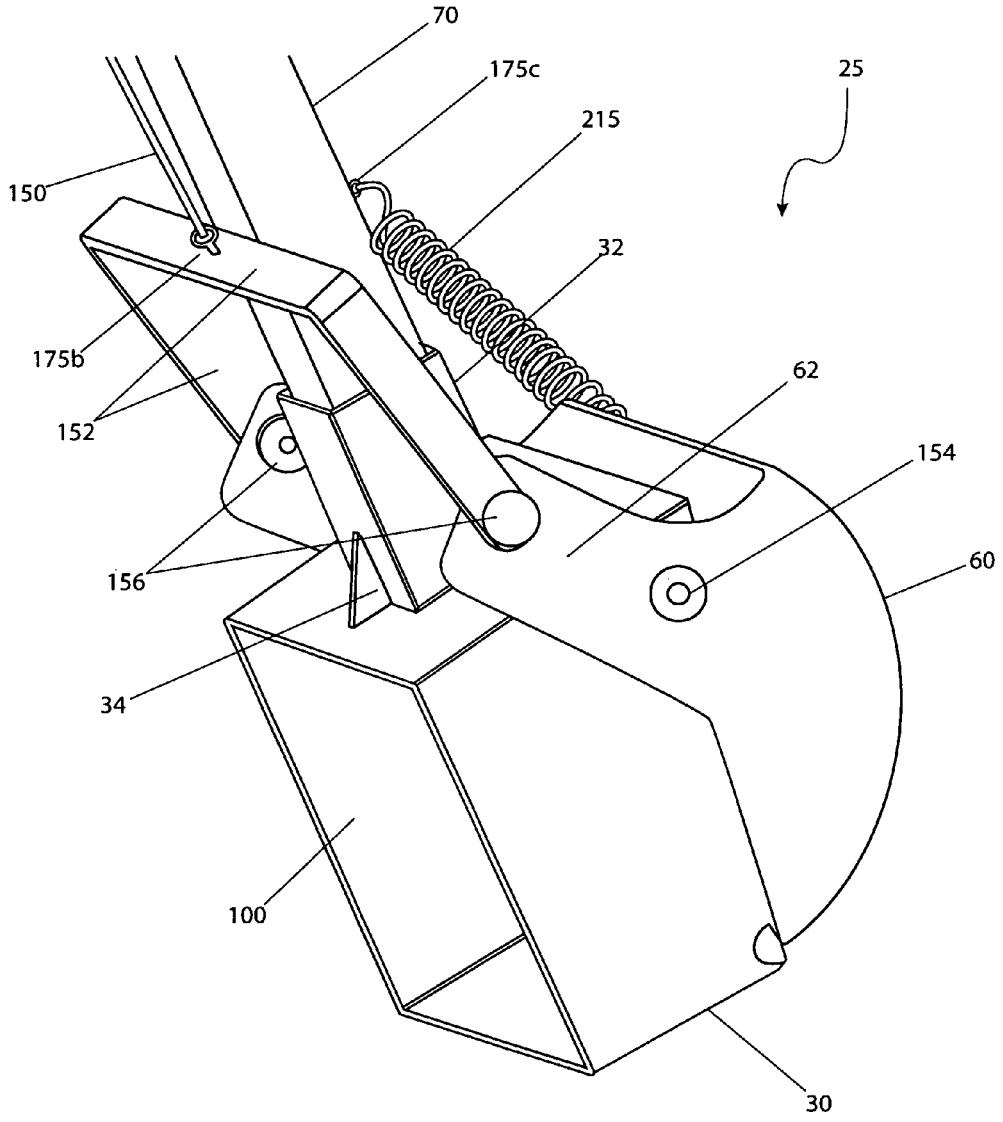
FIG. 3B is a side perspective view of the collection bucket assembly of the animal waste collection device depicting a closed state.
Figure 3C:
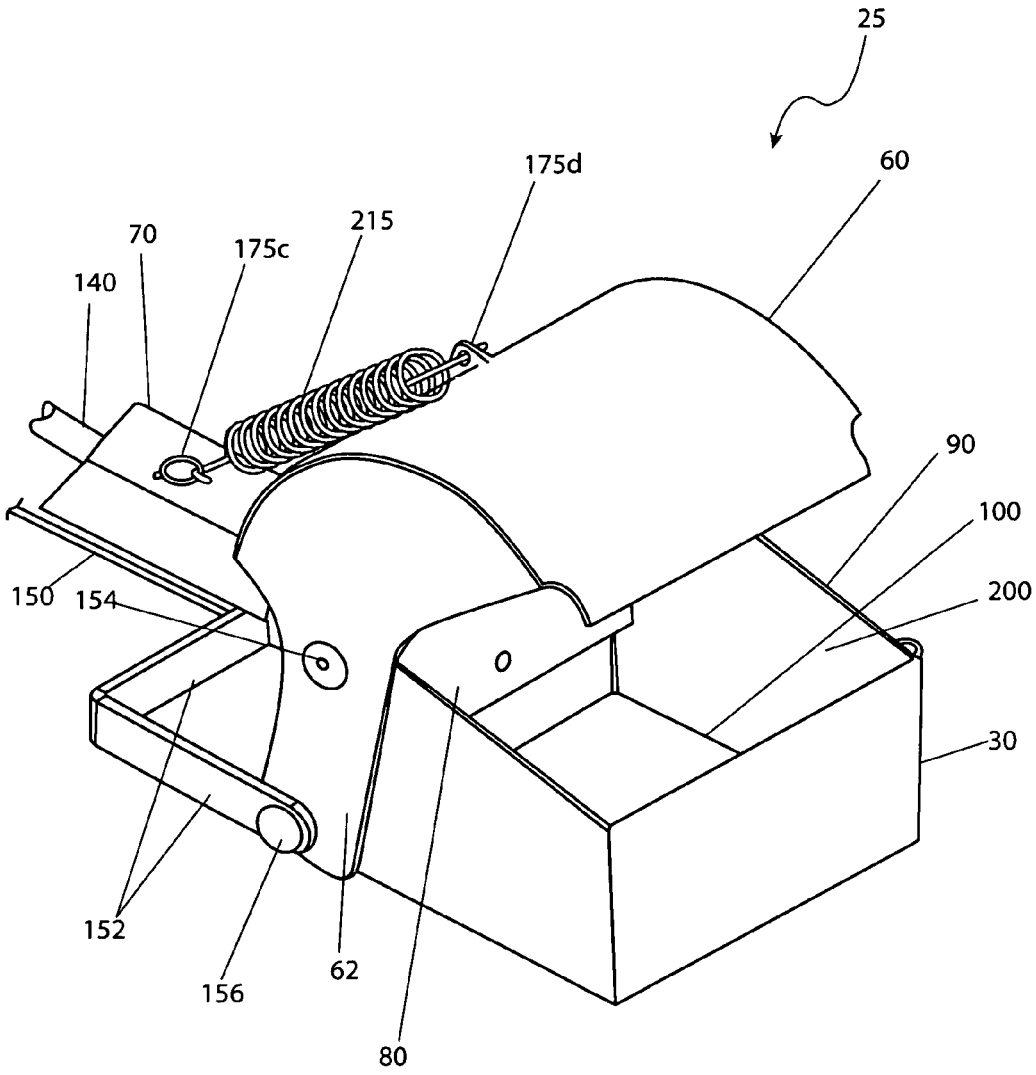
FIG. 3C is a front perspective view of the collection bucket assembly of the animal waste collection device.
Figure 4A:
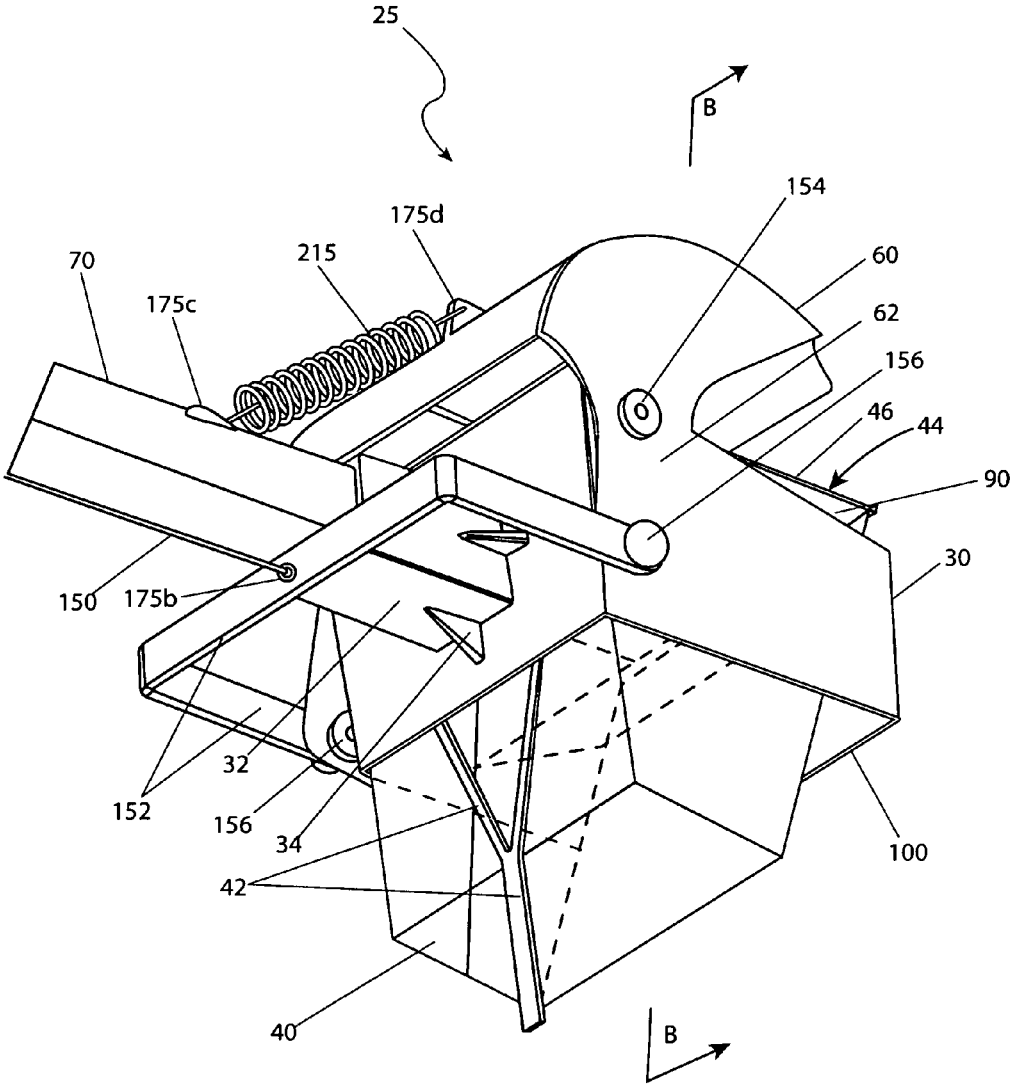
FIG. 4A is a bottom perspective view of the collection bucket assembly of the animal waste collection device depicting attachment of the bag, according to an embodiment of the present invention.
Figures 4B, 4C, 4D:
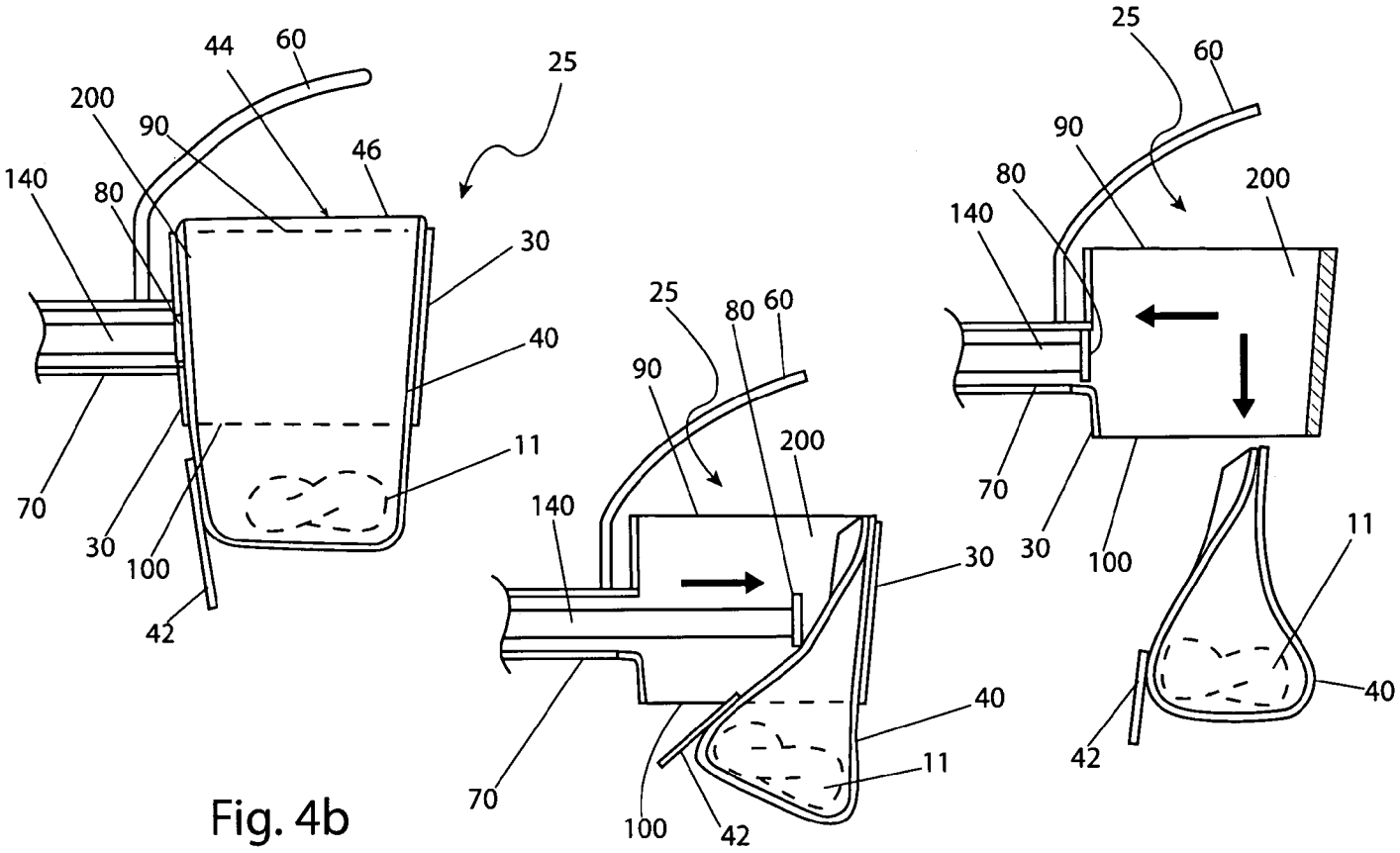
FIG. 4B is a sectional view of the collection bucket assembly depicting attachment of the bag taken along section line B-B of FIG. 4A.
FIG. 4C is a sectional view of the collection bucket assembly depicting detachment of the bag taken along section line B-B of FIG. 4A; and, FIG. 4D is a sectional view of the collection bucket assembly depicting disposal of the bag taken along section line B-B of FIG. 4A.

The plunger mechanism 50 includes a first linkage 140 envisioned to provide a linear rod having a knob 170 affixed to a proximal end, and further including the extraction bar 80 at the distal end (FIGS. 3C and 4B).

The plunger mechanism 50 is further provided with a plunger locking knob 120 and a plunger locking block 122 to maintain the plunger mechanism 50 in a downward position once the plunger mechanism 50 has been extended. The plunger locking knob 120 threadingly engages the plunger locking block 122 and is tightened to secure the plunger locking block 122 in either a retracted or extended position. The plunger locking block 122 provides a pin-tumbler assembly being forward biased using an integral locking spring 124. The plunger locking knob 120, plunger locking block 122, and locking spring 124 are incorporated within an "L"-shaped grip 165 of the handle assembly 15 and work in conjunction with a notch 126 of the first linkage 140 to maintain the plunger mechanism 50 in its downward position. Those skilled in the art will appreciate that other locking mechanisms and methods may be utilized without deviating from the teachings of the present disclosure and, as such, should not be interpreted as a limiting factor.

When it is desired, the plunger mechanism 50 may be retracted by loosening and motioning the plunger locking knob 120 away from the first linkage 140 to release engagement of the plunger locking block 122 and notch 126. This allows a first return-assist 115 (FIG. 3A) to force the plunger mechanism 50 to its upward bias position.

Referring to FIGS. 3A, 3B, and 3C, in an embodiment, the first linkage 140 includes a first return-assist mechanism 115, preferably being a compression spring, located within the elongated shaft 70, which acts to return the first linkage 140 and the extraction bar 80 to their extended positions upon release of the plunger mechanism 50.

The collection bucket 30 includes the first bucket opening 90 onto which the bag 40 is placed and the second bucket opening 100 through which the bag 10 is to fall during release of the bag 10 from the device 10 (FIGS. 4A through 4D). The elongated shaft 70 is permanently affixed to and extends from the collection bucket 30. The elongated shaft 70 is attached to a receiver 32 including a tubular extension of the top of the collection bucket 30. A plurality of gusset plates 34 provides rigidity and additional support to the attachment of the shaft 70 to the collection bucket 30. The elongated shaft 70 provides the necessary structural support to employ the device 10 while a user 300 is in a standing position; to secure the necessary linkage components 140, 150; and, to transfer linear tensile forces of the handle actuator 20 and the plunger mechanism 50 to the collection bucket 30.

In an embodiment, the bucket lid 60 includes a pair of mounting ears 62 each being pivotally attached to the collection bucket 30 via a first hinge pin 154, which enable the bucket lid 60 to pivot from the open state to the closed state. The bucket lid 60 includes an angled or arcuately shaped member and is preferably fabricated from the same material as that of the collection bucket 30.

The angled or arcuate configuration allows the bucket lid 60 to cover the first bucket opening 90 when the bucket lid 60 is in a closed position. Additionally, the bucket lid 60 is in mechanical communication with the second linkage 150 via a connecting third linkage 152. The second linkage 150 is affixed to a third linkage 152 via a second eyelet 175*b*. The third linkage 152 provides a rigid "U"-shaped form being pivotally attached to the bucket lid 60 via a pair of second hinge pins 156 along opposing side surfaces. When the lever 160 is actuated, a tension is applied to the second linkage 150, which in turn motions the third linkage 152 causing the bucket lid 60 to rotate to a closed state (FIG. 2A). It is understood that other various mechanisms may be utilized to remotely open and close the bucket lid 60 and, as such, should not be interpreted as a limiting factor.

Upon release of the lever 160, a second return-assist 215 mechanism returns the bucket lid 60 to the open state. The second return-assist 215 mechanism is envisioned to be a tension spring extending between the elongated shaft 70 and bucket lid 60. The second return-assist 215 is attached to the elongated shaft 70 at a third eyelet 175*c* and to the bucket lid 60 at a fourth eyelet 175*d*. It is understood that other return-assist mechanisms and methods may be utilized without deviating from the teachings of the present disclosure and, as such, should not be interpreted as a limiting factor.

In use, a user 300 inserts the bag 40 within the collection bucket 30; positions the collection bucket 30 behind and the bucket lid 60 over top of the animal excrement 11; and, closes the bucket lid 60 by pivoting the lever 160 to manipulate and entraining the animal excrement 11 within the bag 40.

The collection bucket 30 includes a hollow rectangular structure, having the first bucket opening 90 and the second bucket opening 100. The collection bucket 30 is preferably fabricated from a rigid, light-weight material such as plastic, aluminum, or steel alloy. Further, the collection bucket 30 has a wall thickness enabling attachment of a light thereto. Such a light can also be attached to the handle assembly 15 or bucket lid 60.

Referring now to FIGS. 4A, 4B, 4C, and 4D, the bucket assembly 25 provides a means to hold, collapse, and discard the bag 40 following use. Each bag 40 is envisioned being made using thin polymer sheet form and having a resilient semi-rigid border 46 about a perimeter of a bag opening 44. The bag 40 is to be generally rectangular in cross-section and sized to allow sliding insertion through the first bucket opening 90 of the collection bucket 30.

The border 46 of the bag 40 is to be rigid enough to maintain the bag 40 in place about the first bucket opening 90, but is flexible enough to allow the border 46 to disengage from the first bucket opening 90 when the extraction bar 80 traverses an interior space of the collection bucket 30 via actuation of the plunger mechanism 50 (FIGS. 2A through 2C). Additionally, the bag 40 provides an extraction tab 42 along a rear side surface which provides a means of manually assisting the removal of the bag 40 from the collection bucket 30 if necessary.

The extraction bar 80 provides a rectangular plate structure being integral to, or otherwise affixed to an end of the first linkage 140 extending in a perpendicular manner such as to form a "T" configuration. When the plunger mechanism 50 is in an upward biased position, the extraction bar 80 abuts a rearward inner wall 200 of the collection bucket 30. When the knob 170 of the plunger mechanism 50 is forced inwardly, the extraction bar 80 traverses the interior space of the collection bucket 30 until it abuts a forward inner wall 200 of the collection bucket 30. The configuration of the collection bucket 30 is such that when the extraction bar 80 traverses the interior space of the collection bucket 30, it contacts and collapses an upper portion of the loaded bag 40 positioned within the collection bucket 30.

Once the animal excrement 11 is entrained within the bag 40 within the collection bucket 30, the user lifts the elongated shaft 70 of the device 10 upwardly to a horizontal orientation causing the animal excrement 11 to descend to a bottom of the bag 40. The plunger mechanism 50 is then pushed in a forward direction to force the extraction bar 80 in a forward direction. The extraction bar 80 then forces the bag opening 44 of the bag 40 into a closed and collapsed state as seen in FIG. 4C. The user 300 then positions the collection bucket 30 over a trash receptacle with the second bucket opening 100 of the collection bucket 30 facing downward and draws back the plunger mechanism 50 releasing the extraction bar 80 in a same upward direction. The upward direction of the extraction bar 80 releases the bag 40, allowing the bag 40 to fall through the second bucket opening 100 and into the trash receptacle as seen in FIG. 4D.

Those skilled in the art will recognize that other styles and configurations of the disclosed device 10 can be easily incorporated into the teachings of the present disclosure, and only particular embodiments have been shown and described for purposes of clarity and disclosure and not by way of limitation of scope.

The disclosed embodiments of the device 10 can be utilized by the common user in a simple and effortless manner with little or no training. After initial purchase or acquisition of the device 10 it would be installed and utilized as illustrated in FIGS. 1-4D.

Referring to FIGS. 1-4D, one (1) embodiment of the disclosed method for utilizing the device 10 includes the following steps: 1). acquiring the device 10; 2). retracting the extraction bar 80 and plunger mechanism 50; 3). securing the plunger mechanism 50 in position by tightening the plunger locking knob 120; 4). allowing the first-return-assist 115 to open the bucket lid 60; 5). inserting the bag 40 through the first bucket opening 90 and into the collection bucket 30; 6). allowing the border 46 of the bag 40 to rest upon the first bucket opening 90; 7). positioning an opposing end of the bag 40 so as to extend outwardly from the second bucket opening 100 of the collection bucket 30; 8). transporting the device 10 to a desired location to collect animal excrement 11; 9). positioning the collection bucket 30 behind, and the bucket lid 60 over top of the animal excrement 11; 10). pivoting the bucket lid 60 to a closed position by motioning the lever 160 of the handle actuator 20; 11). allowing the bucket lid 60 to cause manipulation of the animal excrement 11 into the bag 40; 12). lifting the device 11 such that the elongated shaft 70 is in a generally horizontal position to force the animal excrement 11 to fall into the bottom of the bag 40; 13). motioning the plunger mechanism 50 in a forward direction causing the extraction bar 80 to traverse an interior space of the collection bucket 30; 14). allowing the extraction bar 80 to collapse side surface and border 46 of the bag 40; 15). transporting the device 10 to a trash receptacle and positioning the device 10 such that the second bucket opening 100 is directly over the trash receptacle and facing downward; 16). loosening the plunger locking knob 120 to disengage the plunger locking block 122 from the notch 126; 17). allowing the first return-assist 115 to retract the extraction bar 80 into its biased rearward position; 18). disengaging the border 46 of the bag 40 from the first bucket opening 90 of the collection bucket 30; and, 19). releasing and allowing the bag 40 to fall through the collection bucket 30 and into the trash receptacle.

Accordingly, the disclosed animal waste collection device 10 provides for entrainment and disposing of animal excrement 11 in a non-contact manner.

It is understood that once the bag 40 is loaded into device 10, no further contact with the bag 40 is required; from the loading step to the disposal of the bag 40 and its contents 11.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An animal waste collection device comprising:

an elongated shaft comprising a first end and an opposed second end;

a handle assembly connected to said first end of said shaft; and, a collection bucket assembly connected to said second end of said shaft;

wherein a handle actuator of said handle assembly is operatively connected to said collection bucket assembly to collect animal waste therewithin; and, wherein a plunger mechanism of said handle assembly, extending from said first end of said shaft into an internal volume of said collection bucket assembly, is operatively connected to said collection bucket assembly to release said animal waste therefrom.

2. The device of claim 1, wherein said handle actuator comprises:

a grip connected to said shaft;

a lever pivotally connected to said grip; and, a linkage operatively interconnected between said lever and said collection bucket assembly;

wherein actuation of said lever collects said animal waste within said collection bucket assembly.

3. The device of claim 1, wherein said plunger mechanism is movable between an extended position and a retracted position, and wherein said plunger mechanism comprises a linkage extending through said shaft, said linkage comprising a first end extending beyond said handle assembly and an opposed second end extendable into said internal volume of said collection bucket assembly.

4. The device of claim 3, wherein said plunger mechanism further comprises a knob connected to said first end of said linkage.

5. The device of claim 3, wherein said plunger mechanism further comprises an extraction bar connected to said second end of said linkage; and wherein said extraction bar engages a bag disposed within said internal volume of said collection bucket assembly.

6. The device of claim 3, wherein plunger mechanism further comprises a return-assist to bias said plunger mechanism in said retracted position.

7. The device of claim 6, wherein said return-assist comprises a compression spring operatively connected to said linkage.

8. The device of claim 6, wherein said handle assembly further comprises plunger locking mechanism operatively connected to said plunger mechanism to secure said plunger mechanism in said extended position.

9. The device of claim 8, wherein said plunger locking mechanism comprises:

a plunger locking block releasably engaging said linkage;

a locking spring connected to said plunger locking block to bias said plunger locking block into engagement with said linkage; and, a plunger locking knob interconnected to said plunger locking block and said handle assembly to lock said plunger locking block away from linkage.

10. The device of claim 1, wherein said collection bucket assembly comprises:

a collection bucket comprising a first opening, an opposed second opening, and defining an internal volume;

a bucket lid pivotally connected to said collection bucket, said bucket lid movable between an open position away from said collection bucket exposing said first opening and a closed position in contact with said collection bucket and covering said first opening;

wherein said handle assembly is operatively connected to said bucket lid to move said bucket lid from said open position to said closed position to collect said animal waste within said internal volume of said collection bucket.

11. The device of claim 10, wherein said collection bucket assembly further comprises a return-assist to bias said bucket lid in said open position.

12. The device of claim 11, wherein said return-assist comprises a tension spring operatively interconnected to said bucket lid and said shaft.

13. The device of claim 1, further comprising a bag connected with said collection bucket assembly.

14. An animal waste collection device comprising:

an elongated shaft comprising a first end and an opposed second end;

a handle actuator connected to said first end of said shaft, said handle actuator comprising:

a grip connected to said first end of said shaft; and, a lever pivotally connected to said grip;

a plunger mechanism movable between an extended position and a retracted position and comprising:

a first linkage comprising a first end extending from said first end of said shaft and a second end positioned at said second end of said shaft;

a knob connected to said first end of said first linkage; and, an extraction bar connected to said second end of said first linkage;

a collection bucket assembly connected to said second end of said shaft, said collection bucket assembly comprising:

a collection bucket comprising a first opening, an opposed second opening, and defining an internal volume; and, a bucket lid pivotally connected to said collection bucket, said bucket lid movable between an open position away from said collection bucket exposing said first opening and a closed position in contact with said collection bucket and covering said first opening;

a second linkage connected to said lever;

a third linkage operatively interconnected to said second linkage and said bucket lid;

a bag connected to said first opening of said collection bucket, disposed within said internal volume of said collection bucket, and extending outwardly from said second opening of said collection bucket;

wherein actuation of said lever moves said bucket lid into said closed position to collect animal waste within said bag through said first opening of said collection bucket; and, wherein movement of said plunger mechanism to said extending position moves said extraction bar into said interior volume of said collection bucket and engages said bag with said extraction bar to disconnect said bag from said collection bucket and release said bag and said animal waste from said collection bucket through said second opening of said collection bucket.

15. The device of claim 14, further comprising:

a first return-assist operatively interconnected to said shaft and said first linkage to bias said plunger mechanism in said retracted position; and, a second return-assist operatively interconnected to said shaft and said bucket lid to bias said bucket lid in said open position.

16. The device of claim 15, further comprising plunger locking mechanism operatively connected to said plunger mechanism to secure said plunger mechanism in said extended position.

17. The device of claim 16, wherein said plunger locking mechanism comprises:

a plunger locking block releasably engaging a notch disposed in said first linkage;

a locking spring connected to said plunger locking block to bias said plunger locking block into engagement with said notch of said first linkage; and, a plunger locking knob interconnected to said plunger locking block and said grip to lock said plunger locking block away from said notch in said first linkage.

18. The device of claim 16, wherein said bag comprises a border defining an opening of said bag, and wherein said border is releasably connected to said first opening of said collection bucket.

* * * * *